US012145631B2

(12) United States Patent
Laffin

(10) Patent No.: US 12,145,631 B2
(45) Date of Patent: Nov. 19, 2024

(54) STATION WITH INFINITE INGRESS AND EGRESS TIMES FOR USE IN TRANSPORTATION SYSTEMS

(71) Applicant: DISNEY ENTERPRISES, INC., Burbank, CA (US)

(72) Inventor: Kristopher M. Laffin, Los Angeles, CA (US)

(73) Assignee: Disney Enterprises, Inc., Burbank, CA (US)

( * ) Notice: Subject to any disclaimer, the term of this patent is extended or adjusted under 35 U.S.C. 154(b) by 940 days.

(21) Appl. No.: 17/185,396

(22) Filed: Feb. 25, 2021

(65) Prior Publication Data

US 2022/0266875 A1 Aug. 25, 2022

(51) Int. Cl.

| | |
|---|---|
| ***B61B 1/02*** | (2006.01) |
| ***A63G 7/00*** | (2006.01) |
| *A63G 3/02* | (2006.01) |

(52) U.S. Cl.

CPC ..... *B61B 1/02* (2013.01); *A63G 7/00* (2013.01); *A63G 3/02* (2013.01)

(58) Field of Classification Search

CPC ..... B61B 1/02; A63G 21/18; A63G 3/02
See application file for complete search history.

(56) References Cited

U.S. PATENT DOCUMENTS 534,818 A * 2/1895 Davis ..... B61B 1/02 104/28
1,207,930 A * 12/1916 Kelley ..... B61B 1/02 104/28
1,303,835 A * 5/1919 Weber ..... B61B 1/02 104/28
2,657,642 A * 11/1953 Babcock ..... B61B 1/02 104/28
3,727,558 A * 4/1973 Winkle ..... B66B 29/08 472/2
3,788,232 A * 1/1974 Schneider ..... B61B 13/00 104/28
3,865,041 A * 2/1975 Bacon ..... B61K 1/00 404/1
4,036,146 A * 7/1977 Tyus ..... B61B 13/10 104/119
4,337,704 A * 7/1982 Becker ..... A63G 3/00 472/117
4,543,886 A * 10/1985 Spieldiener ..... B62D 57/00 104/73

(Continued)

*Primary Examiner* — Scott A Browne
(74) *Attorney, Agent, or Firm* — Dorsey & Whitney LLP

(57) ABSTRACT

A ride system adapted to eliminate delays caused by variances in loading or unloading through the inclusion of an infinite ingress/egress station within the ride path. The station provides a system to circumvent the vehicle in series design methodology, which allows the station to operate to pull a vehicle out of the line or series of vehicles if an issue arises during loading or unloading. This is achieved using a circular turntable that is rotated with a series of vehicles attached to the outer edge of the rotating turntable so as to be moved along the ride path by the turntable during loading and unloading operations. The station is configured to allow a vehicle identified as having load or unload issues to continue to travel with or around the turntable instead of being released into the attraction along the ride path as would be the case for properly loaded/unloaded vehicles.

20 Claims, 13 Drawing Sheets

(56) References Cited

U.S. PATENT DOCUMENTS

| | | | | |
|---|---|---|---|---|
| 4,833,997 | A * | 5/1989 | Cathiard | B61B 12/122 104/180 |
| 5,033,392 | A * | 7/1991 | Schemitsch | A63G 3/00 104/73 |
| 5,873,310 | A * | 2/1999 | Creissels | B61B 1/02 104/178 |
| 6,170,403 | B1 * | 1/2001 | Behringer | A63G 7/00 104/73 |
| 6,237,499 | B1 * | 5/2001 | McKoy | B63B 1/16 104/70 |
| 8,091,483 | B1 * | 1/2012 | Sumner | A63G 3/00 104/73 |
| 10,835,832 | B2 * | 11/2020 | Fontiveros Penso | B61B 3/00 |
| 11,584,406 | B2 * | 2/2023 | Alarcon | B61B 13/00 |
| 2010/0078291 | A1 * | 4/2010 | Fritsche | B66B 21/10 198/324 |
| 2010/0242784 | A1 * | 9/2010 | Oguro | H01L 21/67715 104/130.01 |
| 2013/0025491 | A1 * | 1/2013 | Crawford | A63G 3/02 104/73 |
| 2013/0059670 | A1 * | 3/2013 | Crawford | A63G 1/00 472/36 |
| 2020/0269888 | A1 * | 8/2020 | Alarcon | A63G 7/00 |
| 2020/0306652 | A1 * | 10/2020 | Fontiveros Penso | B61B 1/02 |
| 2020/0307650 | A1 * | 10/2020 | Fontiveros Penso | B60R 21/01 |
| 2020/0307651 | A1 * | 10/2020 | Bertoncello | A63G 31/00 |
| 2020/0307658 | A1 * | 10/2020 | Towns, Jr. | A63G 31/00 |
| 2021/0062567 | A1 * | 3/2021 | Majdali | A63G 7/00 |

* cited by examiner

STATION WITH INFINITE INGRESS AND EGRESS TIMES FOR USE IN TRANSPORTATION SYSTEMS

BACKGROUND

1. Field of the Description

The present description relates, in general, to loading and unloading stations of rides of amusement parks, theme parks, and water parks and other applications, and, more particularly, to a ride station configured to provide extended or even unlimited (or "infinite") passenger ingress and egress time of one up to many passenger vehicles while allowing ongoing dispatch of other passenger vehicles at or near desired throughput rates for a ride.

2. Relevant Background

It is often desirable for transportation systems such as rides at theme parks, amusement parks, and other mass transit systems to be operated to provide a continuous flow of visitors at a known rate. Often, it is one goal of ride designers to provide high throughputs to try to increase the number of park visitors that can enjoy a ride and to shorten wait times. An ongoing challenge for designers of these higher capacity rides is how to handle variations in load and unload (or ride ingress and egress) times between varying groups of vehicle passengers and what to do about interruptions to the load and unload process for a ride.

Most high capacity attractions are designed to have the vehicles travel along a single, continuous path or in a "vehicles in series" configuration. This goes for most attraction types regardless of if they have a track, flume, or pathway. For the vehicles in series configuration, the attraction timing and efficiency are tied to every single vehicle because there is no way to bypass a vehicle that may be causing an attraction backup. A typical example of slower ingress and egress times for a passenger is long passenger load/unload times, where ride operators cannot advance a vehicle within the designed dispatch time because a passenger is taking longer than expected to ingress or egress the vehicle. Since all of the vehicles are in series along the track, the vehicles behind the slow load/unloading vehicle must wait, which leads to further backups of vehicles. These backups quickly move upstream throughout the attraction or ride. This is known as a cascade, which is well documented as an issue for ride designers and operators that reduces the capacity of an attraction. A vehicle in series design, as a result, ensures that attractions are categorically affected by any type of timing issue be it minor, major, common or uncommon, thereby reducing the overall passenger or visitor capacity of these very common types of park attractions.

A wide variety of approaches have been tried to reduce or eliminate these delays for single, continuous path-type rides, but, unfortunately, none has been wholly successful or practical. Some attractions have transfer tracks or spur tracks that allow some vehicles to load at a slower pace. The lateral track switch is a section of track that translates sideways and out of line with the continuous attraction track. When the vehicle is loaded, the track is then moved back in line with the other continuous attraction track. This configuration is often not desirable as it is very limited by capacity as typically only one vehicle can be diverted at a time. Since loading/unloading issues happen fairly often, the lateral track switch configuration only helps on a few of these occasions as opposed to every occasion. Additionally, passengers cannot load or unload while the transfer is happening, which means that this approach is really only beneficial if one can predict and plan for a slow loading or unloading passenger. However, it is very difficult to predict when and which passengers will have difficulty entering a vehicle, have confusion about a restraint, forget a personal item, or the like, and these slower loading and unloading situations will still occur with no means of rectifying the slowdowns. Further, lateral track switches usually require large and complex equipment that may be cost or space prohibitive as they require an extra vehicle position in the station area and space enough to transfer two parallel track sections back and forth.

Another potential approach to addressing the slow loading or unloading problem is to increase the dispatch interval or by decreasing the number of vehicles on the track to allow slow loading/unloading passengers more time. This design will likely lead to fewer disruptions, but such a design is unwanted in many cases as it ensures less passengers ride a particular attraction per hour. Further, such a design does not make the ride immune to delays in loading and unloading. Station length could be increased to allow multiple vehicles to load at a time, which can give passengers more time to load and unload. Unfortunately, as noted for the longer dispatch interval configuration, an increase in unload/load time only makes delays less likely without preventing their occurrence. In yet another approach to the delay problem, some attractions have two stations providing loading and/or unloading platforms. This allows time for a vehicle to load in one station while the other station dispatches and provides some resiliency to passenger loading and unloading issues. While having some positive effect on the overall capacity of the attraction, the two station design does not make the attraction immune to backups because loading and unloading problems can occur on multiple vehicles at a time. Further, use of more than one station requires more space and complex systems and equipment to ensure this configuration operates efficiently.

SUMMARY

Briefly, a station or hub is provided for use in ride systems to provide passengers with indefinite load and unload times. To this end, the station is especially adapted to utilize a continuously rotating turntable that independently captures or retains each vehicle in a series exiting a main ride track and guides the vehicles in a station track about the rotating turntable. A transfer guide track is used to facilitate both this input of vehicles into the station (for unloading/loading) and their later output back onto the main track at a station exit. A vehicle capture assembly is provided on the turntable to capture and cause these vehicles to move with the turntable while in the station. Then, when properly unloaded and loaded, the vehicle capture assembly operates to selectively release each vehicle (with guidance by the transfer guide track) onto the main ride track. When not properly unloaded or loaded, the vehicle capture assembly retains them in the captured state and guides the vehicle back around the turntable and the station entrance. In this manner, one, two, or more vehicles can at any time be making a second loop to extend the loading and unloading times as useful for each set of passengers.

More particularly, a ride system is provided that is adapted for infinite ingress/egress times. The system includes a plurality of vehicles and a main track for guiding the vehicles in a series along a ride path. A turntable is provided that rotates in a continuous, single speed manner about a center axis while the ride system is operating. The system also includes a station track extending about an outer edge of the turntable to define a circular loop around a periphery of the turntable, and the main track includes a turntable inlet that directs the vehicles in the series toward the station track and a turntable outlet providing an exit for the vehicles away from the station track. Further, the system includes a transfer guide track with an inlet portion configured to guide the vehicles from the turntable inlet of the main track to the station track and with an outlet portion configured to guide the vehicles from the station track to the turntable outlet of the main track. In practice, one or more of the vehicles is guided to bypass the turntable outlet and continue to travel within the station track past the turntable inlet of the main track and back to the turntable outlet of the main track.

In some embodiments, a vehicle capture system is provided (e.g., on the turntable) with a vehicle-to-turntable coupling mechanism independently coupling each of the vehicles arriving from the turntable inlet of the main track to the turntable, whereby the vehicles are driven in the station track by rotation of the turntable. The vehicle capture system may include a release mechanism activated in response to a control signal from a ride control system to independently decouple each of the vehicles when traveling in the outlet portion of the transfer guide track except for the one or more of the vehicles that are guided to bypass the turntable outlet.

In some cases, the vehicle-to-turntable coupling mechanism includes a plurality of spring-loaded pins or balls mounted on the turntable and a turntable link device on a chassis of each of the vehicles with a hole or recessed surface for receiving one of the spring-loaded pins or balls. In the same or other implementations, the inlet and outlet portions of the transfer guide track each may include a pivotable section that is acted upon by the one or more vehicles that are guided to bypass the turntable outlet to rotate out of a path of the one or more vehicles and to then spring back into place, thereby allowing the one or more vehicles to continue to travel in the station track without binding with the transfer guide track.

Each of the vehicles may include a transfer guide wheel extending outward from a side of the chassis opposite the turntable as the vehicle travels within the station track, and the transfer guide track may include two or more surfaces for mating with the transfer guide wheels of the vehicles. In some implementations, the station track includes a channel with a bottom surface supporting and mating with up-stop wheels of the vehicles to provide vertical support of the vehicles while traveling around the turntable. In such implementations, the transfer guide track can be mounted on a sidewall of the channel of the station track that is opposite the turntable.

In some embodiments of the ride system, the main track has an additional one or more of the turntable inlets and an additional one or more of the turntable outlets to provide access to an additional one or more branches of the ride path. The transfer guide track may then include additional inlet and outlet portions paired with the additional turntable inlets and outlets, and each of the vehicles can selectively exit the station track via the transfer guide track through any one of the turntable outlets.

DETAILED DESCRIPTION OF THE PREFERRED EMBODIMENTS

Briefly, the following description describes a system for use in a theme or amusement park ride or other application in which vehicles, such as passenger vehicles of a roller coaster or raft ride, are directed along a ride path sequentially or as "vehicles in series." The new system is adapted to eliminate or at least reduce delays caused by variances in loading or unloading through the inclusion of an infinite ingress/egress station (also labeled an infinite load/unload time station) within the ride path.

The proposed infinite load/unload time station provides a system to circumvent the vehicle in series design methodology, which allows the ride system to pull a vehicle out of the line or series of vehicles if an issue arises during loading or unloading. Briefly, this is achieved using a circular station platform or turntable that is rotated with a series of two-to-many vehicles attached to the outer edge or periphery of the rotating turntable so as to be moved along the ride path by the turntable during loading and unloading operations. The infinite load/unload time station is configured to allow a vehicle identified as having load or unload issues to continue to travel with or around the turntable instead of being released into the attraction along the ride path (or on a main track or water channel) as would be the case for properly loaded/unloaded vehicles. This extra loop (or loops if needed, which provides the label "infinite" to the station) around the turntable (and load/unload areas) provides the rider(s) an indefinite amount of time to load or unload a vehicle as the vehicle can be sent around the circular path or loop adjacent the turntable as many times as needed to allow them to load or unload the vehicle safely and properly.

Figure 1:
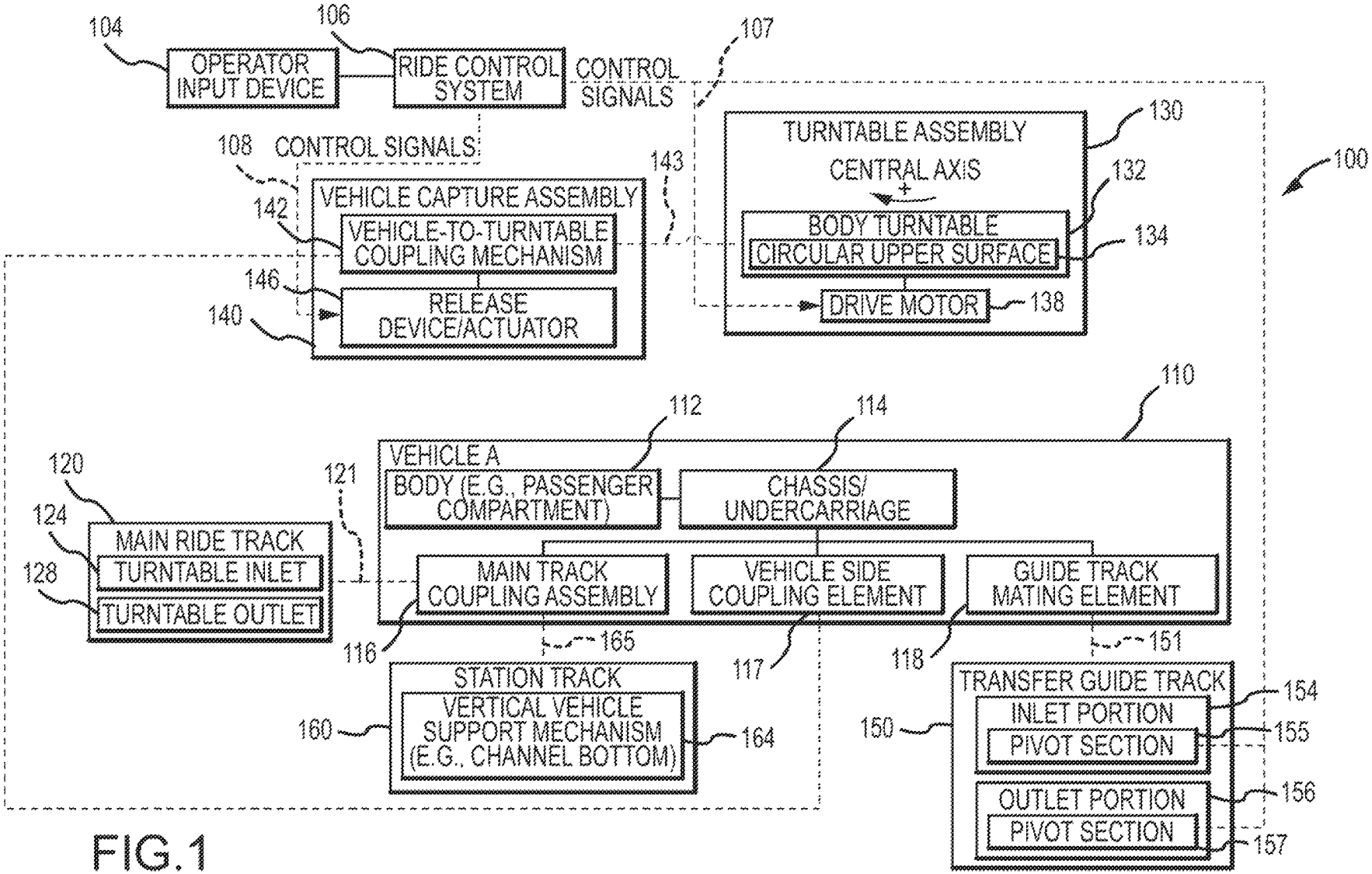
FIG. 1 is a functional block diagram of an amusement park ride with a station of the present description configured for providing infinite ingress and egress times to passenger vehicles.

FIG. 1 is a functional block diagram of an amusement park ride (or vehicle transfer system) 100 with a station of the present description configured for providing infinite ingress and egress times to passenger vehicles 110. One passenger vehicle 110 is shown with the understanding that there would typically be many such vehicles arranged to travel along the ride path of the system 100 sequentially one after the other in a line or series of such vehicles. The station may be provided in the ride path by placing the station in the main ride track 120 between a turntable inlet 124 and a turntable outlet 128, with the main ride track 120 defining the ride path of the system 100 and with the station providing a place for loading and unloading the vehicle 110. In general, the station may include the turntable assembly 130, the transfer guide track 150, the station track 160, and the vehicle capture assembly 140 as well as the operator input device 104 and ride control system 106 (or a portion thereof).

The ride/system 100 may take a wide variety of forms including nearly any existing or to be built ride that directs the passenger vehicle 110 in series with other such vehicles along a ride path defined by the main ride track 120. These may include roller coaster-type rides, water raft-type rides, and so on, and the passenger vehicle 110 and track 120 would be adapted for the type of motion or driving systems provided in that particular type of ride design. In the ride 100, the vehicle 110 is shown to include a body or passenger compartment 112 for receiving one, two, or more passengers in a seated or standing arrangement. Further, a chassis or undercarriage 114 is provided that is affixed to the body 112 (above or below the body depending on whether the vehicle is supported on the track 120 from above or below). To this end, the vehicle 110 also includes a main track coupling assembly 116 for engaging (as shown with dashed line 121) the main ride track 120 to allow and/or facilitated the vehicle 110 to move along a ride path defined by the track (e.g., to roll upon contact surface of the main track in a guided manner).

The turntable assembly 130 includes a body or turntable 132 with a circular (and typically planar) upper surface 134 that is used for loading and unloading passengers from the vehicle 110 as the vehicle 110 travels about the periphery of the turntable 132 in or on a station track 160. To allow the vehicle 110 to continue for another loop when load/unload issues arise, the station track 160 is also circular in shape and extends about the entire circumference of the turntable 132, and the station track 160 includes a vehicle support mechanism 164 adapted for supporting the vehicle 110 vertically during this station-based travel. As shown, with dashed line 165 the main track coupling assembly 116 may engage or be used for mating with the vertical vehicle support mechanism 165 such as with wheels or rollers to ride upon a support surface such as a channel bottom or a track section.

The turntable assembly 130 further includes a drive motor 138 that operates in response to control signals 107 from the ride control system 106 to rotate the turntable 132 about its central axis as shown. The rotation of the turntable 132 is continuous during the operation of the ride 100 (except for emergencies). This is a unique feature of the ride 100 because the inclusion of the infinite load/unload time station allows any vehicles 110 having load/unload issues to continue to move on the station track 160 (independent from upstream vehicles) rather than being directed to the turntable outlet 128 and onto the main track 120. Such operation is in direct contrast to prior rides, such as many raft rides in which the turntable is stopped when an issue arises delaying all upstream vehicles from departure. This selective retention of a vehicle 110 during load/unload issues may occur in response to an operator's input or lack thereof via the ride control system 106, as is shown by control signals 108 being provided to a release device/actuator 146 of a vehicle capture assembly 140. In such an example, the operator verifies proper loading/unloading of the vehicle 110 and, when verified, uses the operator input device 104 (e.g., a green button or green icon on a touch screen or the like) to cause the ride control system 106 to transmit a release command 108 to the release device/actuator 146 to disengage the vehicle 110, and, more specifically, the vehicle side couple element 117, from the turntable 132.

To move the vehicle 110 from the main track 120 and ride path into the station for loading and unloading, the ride or system 100 includes a transfer guide track 150. Further, each vehicle 110 includes a guide track mating element 118 upon the chassis 114 to engage or couple with the transfer guide track 150 as shown with dashed line 151. More specifically, an inlet portion 154 of the transfer guide track 150 is provided to receive incoming vehicles 110 at the turntable inlet 124 of the main ride track 120 and to transfer these vehicles 110 to the station track 160. Likewise, an outlet portion 156 of the transfer guide track 150 is provided to send outgoing vehicles 110 at the turntable outlet 128 of the main ride track 120 to travel along the ride path or to enter the attraction. As will become clearer from the description below, each of the transfer guide track portions 154 and 156 includes a pivot section 155 and 157, respectively, that allows a vehicle 110 that is retained or remains captured by the vehicle capture assembly 140 (e.g., during a load/unload issue) to remain upon the station track 160.

To facilitate "capture," each vehicle 110 includes a vehicle side coupling element 117 that may be provided upon the track support chassis 114. The vehicle capture assembly 140, which often will be provided on an outer edge of the turntable 132 as to extend into or near the station track 160 as shown with dashed line 143, includes a vehicle-to-turntable coupling mechanism 142 that is operable to engage the vehicle side coupling element 117 as the vehicle moves along the inlet portion 154 of the transfer guide track 150. This engagement or coupling is continued while the vehicle 110 travels in the station track 160 during loading and unloading so as to drive the vehicle 110 with rotation of the turntable 132 so that the vehicle 110 and turntable 132 move at the same speed facilitating loading and unloading onto the upper surface 134 (or to an outer surface/walkway in some cases). The initial coupling between mechanism 142 and element 117 on the vehicle 110 often will be passive (or non-actuated) such as with one or more spring loaded pins, balls, or the like provided in mechanism 142 and being received at least partially by the coupling element 117.

When loading/unloading is determined by an operator to be completed satisfactorily, the release device/actuator 146 is operated to decouple or disengage the coupling mechanism 142 from the vehicle side coupling element 117. With the vehicle 110 released from the turntable 110, the vehicle 110 engages the outlet portion 156 of the transfer guide track 150 with the guide track mating element 118, and the pivotal section 157 pivots to transfer the vehicle 110 at the turntable outlet 128 onto the main ride track 120 with the main track coupling assembly 116 mating with portions of the main ride track 120.

Figure 2:
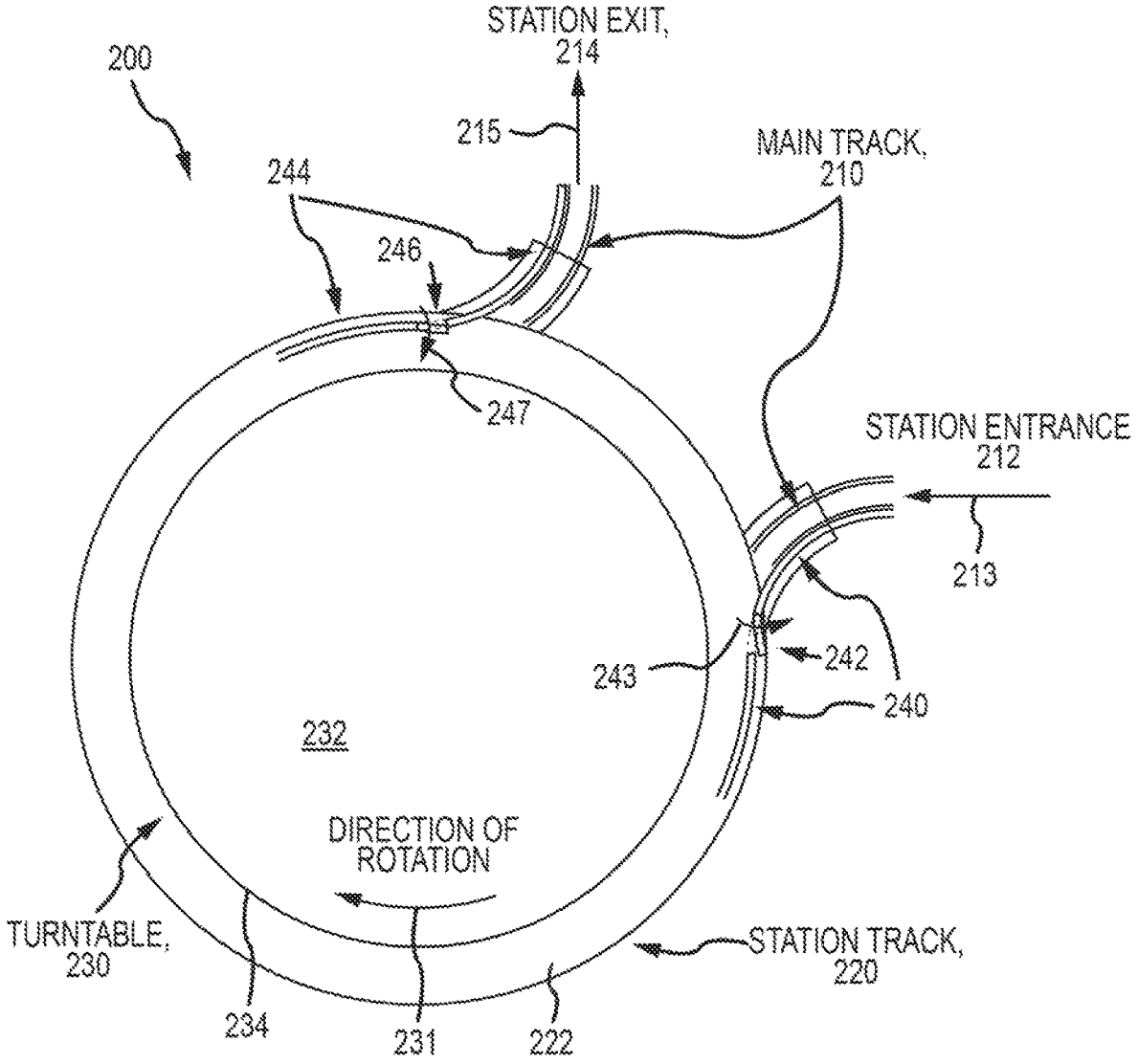
FIG. 2 is a top schematic view of a station for use in a roller coaster implementation of the ride of FIG. 1 prior to use by vehicles.

With this general understanding of the infinite load/unload time station in mind, it may now be useful to turn to a more specific exemplary implementation of these concepts. FIG. 2 is a top schematic view of a station 200 for use in a roller coaster implementation of the ride 100 of FIG. 1 shown prior to the arrival of vehicles in the station 200. In such a roller coaster configuration, vehicles ride upon a track that defines the ride path through an attraction. The design of the station 200 is a circular shape that includes three track sections and one rotating turntable 230. Particularly, a main track 210 is included with a first portion at a turntable inlet or station entrance 212 with an arrow 213 indicating direction of travel of a vehicle along the ride path out of the attraction and into the station for loading/unloading. The main track 210 also includes a second portion at a turntable outlet or station exit 214 with an arrow 215 indicating direction of a travel of a vehicle along the ride path into the attraction.

During operations of the station 200, the turntable 230, which includes upper surface 232 that is used in many cases for passenger ingress and egress, is rotated as shown with arrow 231 in a clockwise direction about its center axis. About the turntables outer or peripheral edge 234, a station track 220 is provided. In the illustrated embodiment, the station track 220 is provided in the form of channel (with a generally U-shaped sectional shape) that extends about the entire circumference of the turntable 230 to define a circular load/unload path for vehicles while in the station 200, and, to provide vertical support of vehicles, the track 220 may include the bottom channel surface 222 (or track members may be provided in other cases). Additionally, the station 200 includes an inlet portion of transfer guide track 240 and an outlet portion of transfer guide track 244 disposed between the main track 210 and the station track 220 at the station entrance 212 and exit 214. Each includes a pivoting track section 242 and 246 that is adapted to pivot as shown with arrow 243 and 247, respectively, to allow a vehicle to continue to rotate with the turntable 230 when a load/unload issue is identified by an operator of the station 200.

Figure 3:
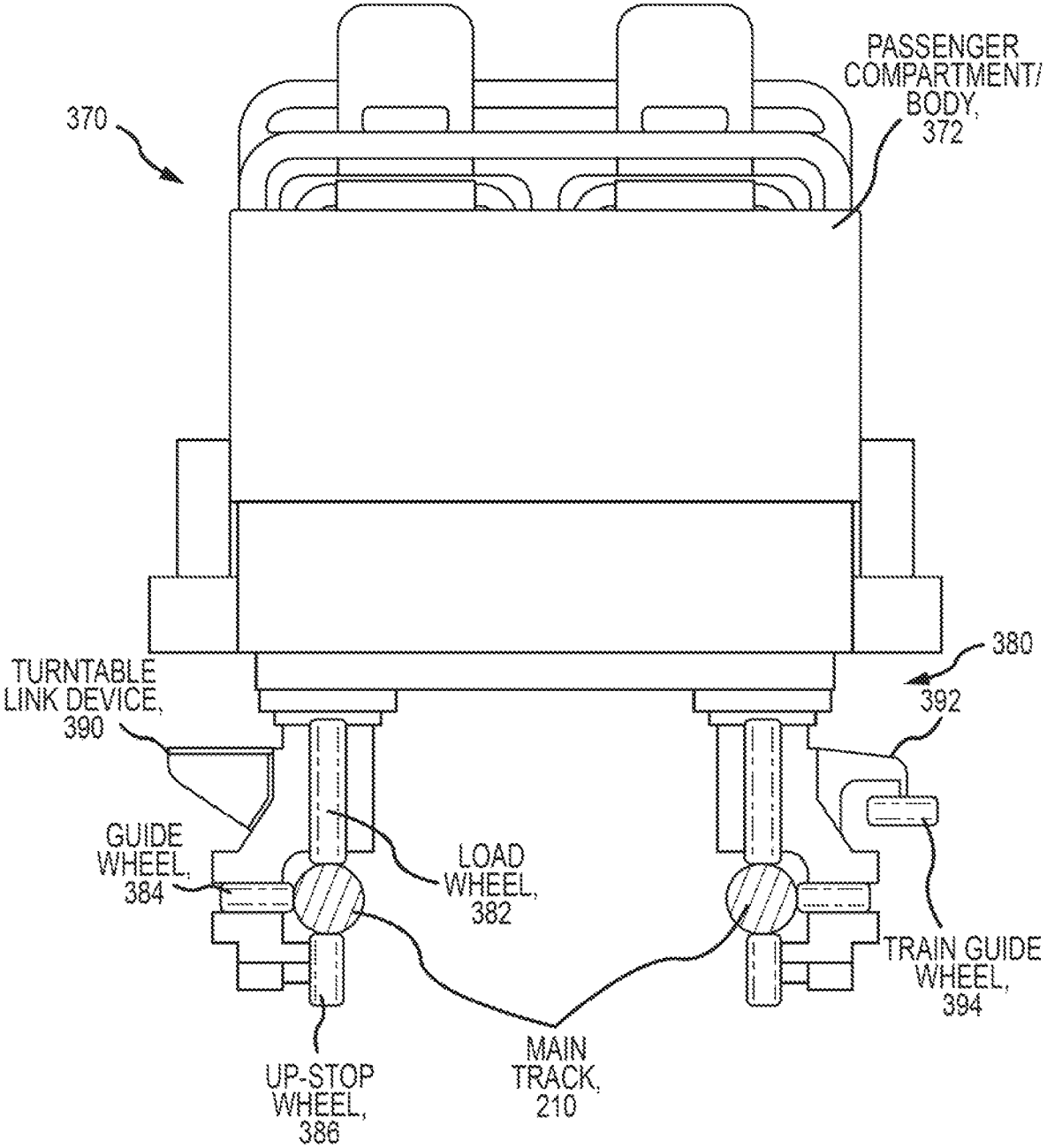
FIG. 3 is an end view of a roller coaster-type vehicle for use in the station of FIG. 2 and ride of FIG. 1 while riding on a section of the ride's main track illustrating the addition of a transfer guide wheel and a turntable link or coupling device.

FIG. 3 is an end view of a roller coaster-type vehicle 370 for use in the station 200 of FIG. 2 and ride 100 of FIG. 1 such as for vehicle 110. The vehicle 370 is shown while riding on a section of the ride's main track 210, outside of the station area, illustrating the addition of a transfer guide wheel 394 and a turntable link or coupling device 390 onto the vehicle 370. The vehicle 370 includes a passenger compartment/body 372 for receiving and restraining passengers (not shown), and a chassis or undercarriage 380 is affixed to or supports the passenger compartment 370 as it travels upon the main track 210. To this end, the chassis includes load wheels 382 (e.g., one to two or more on each side to ride on two circular beams of track 210), guide wheels 384, and up-stop wheels 386.

Significantly, though, the vehicle 370 further includes one, two, or more transfer guide wheels 394 and one, two, or more turntable link devices 390. The transfer guide wheels 394 are provided on the chassis 380 on a side opposite the turntable and are configured, such as with an extension arm 392 to extend outward from the chassis 380 a distance and with a proper orientation for mating with sections of the transfer guide track of a station. A single, horizontal wheel is shown for each of these "guide wheels" 394 but other configurations may be used to suit the configuration of the guide track such as a vertical wheel, a plurality of smaller wheels or bogies, roller balls, and so on. The turntable link devices 390 are provided on the chassis 380 on a side proximate the turntable and are configured, such as with a support flange with an upper plate with one or more holes or recessed surfaces as shown, to receive pins, balls, or other mating components of a vehicle-to-turntable coupling mechanism (such as mechanism 142 in FIG. 1) of a vehicle capture assembly on the turntable. As with the guide wheels 394, the turntable link devices 390 may take a wide variety of forms to facilitation "capture" or physical linking or coupling with the turntable (or its peripheral edge or side) to cause the vehicle 370 to be driven in the station track by the rotation of the turntable.

Figure 4:
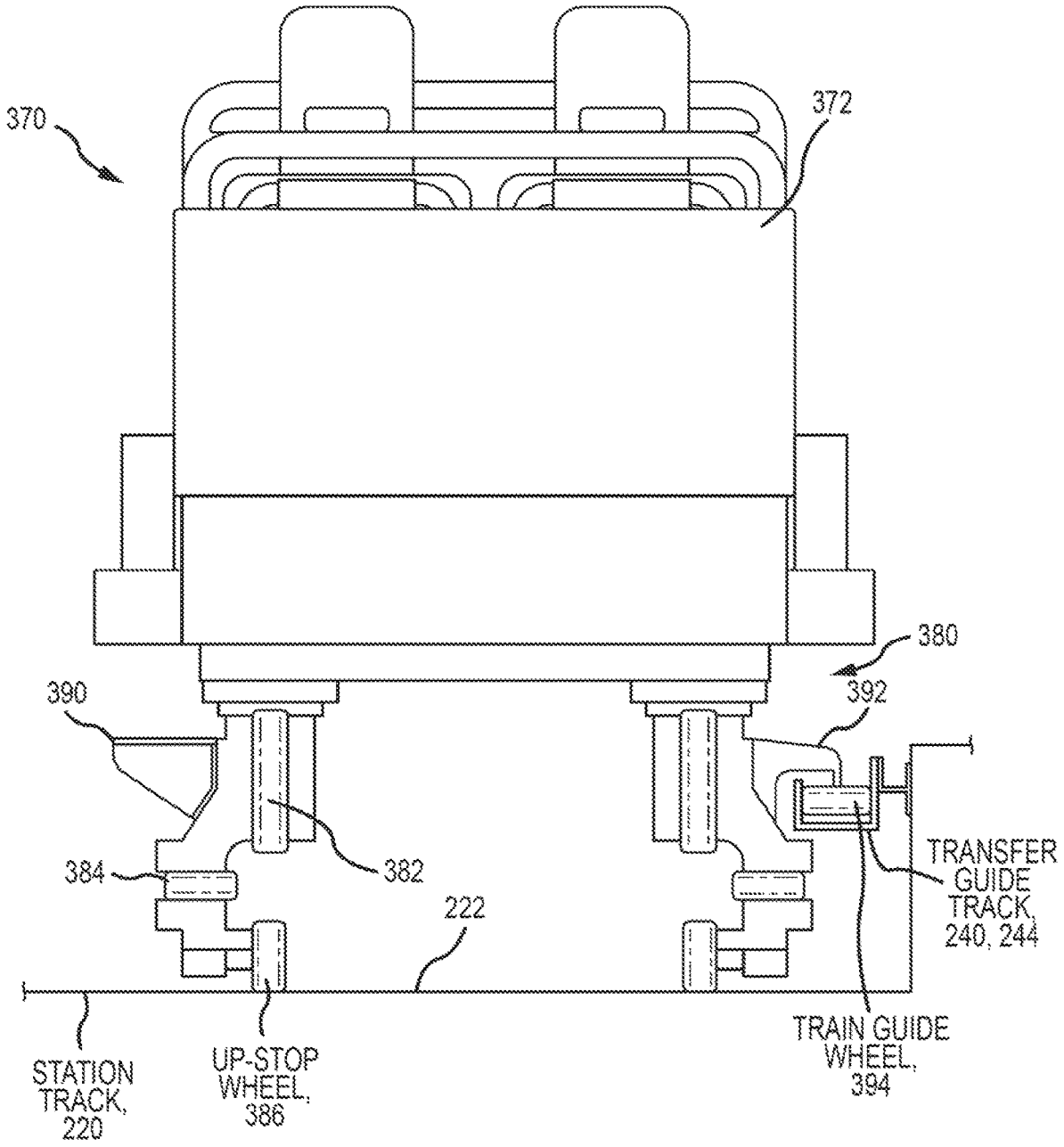
FIG. 4 illustrates the vehicle of FIG. 3 when it is being guided by a transfer guide track and being vertically supported by a station track.
Figure 5:
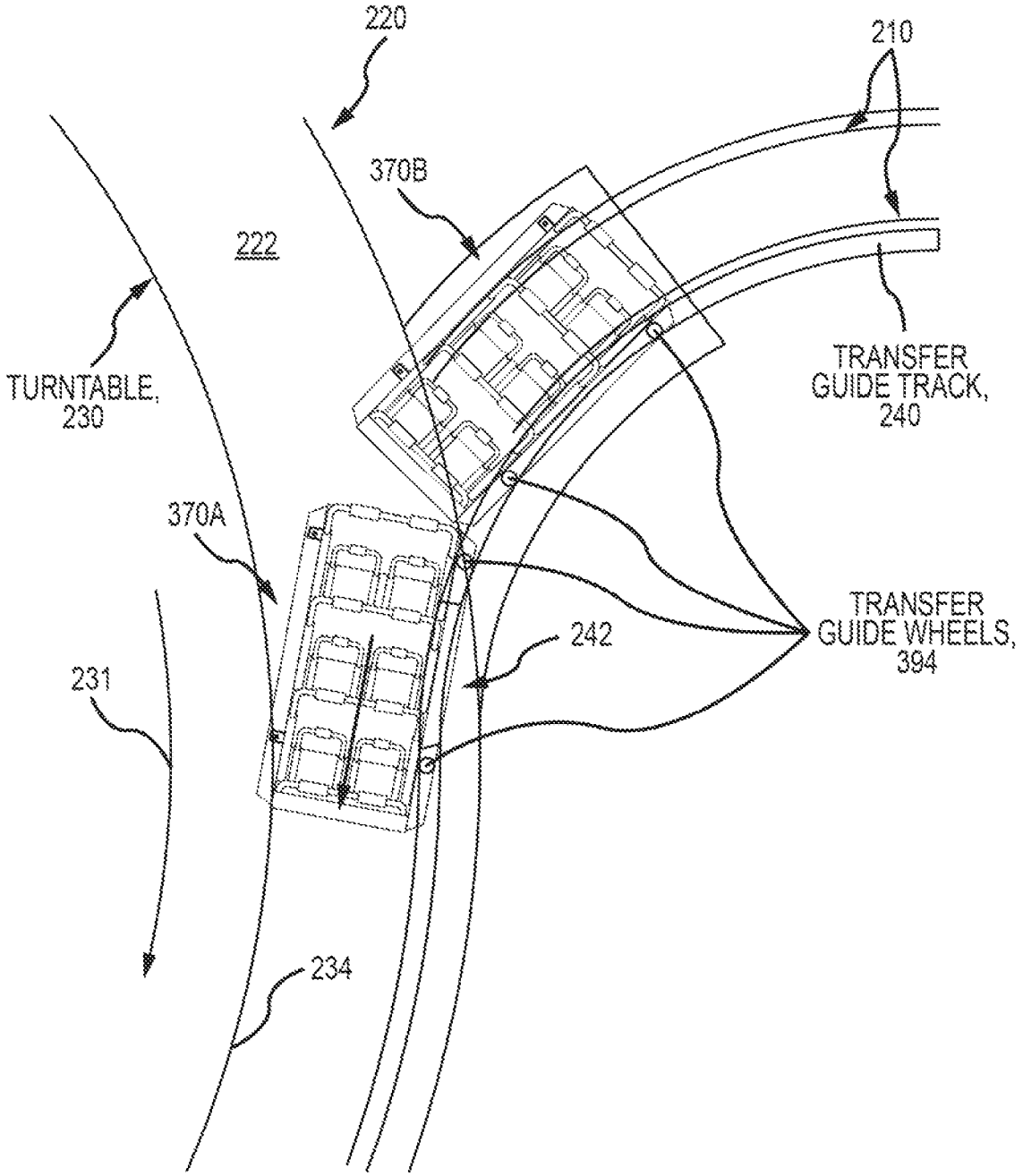
FIG. 5 is a top view similar of a portion of the station of FIG. 2 as a pair of vehicles (which may be configured like the vehicle of FIGS. 3 and 4) transition from the main track to a transfer guide track at an inlet to the station.

As vehicles such as vehicle 370 approach the end of a ride on main track 210, they will enter the station 200 using the station entrance 212. As the vehicle 370 moves onto the station entrance 212, they are using the main track 210, which is used to support the load of the vehicle 370 through the ride as shown in FIG. 3. Before the vehicle 370 can move into the station 200, it will first transfer into the inlet portion of the transfer guide track 240, which is used to guide the direction of the vehicles 370A and 370B into the station with motion in the direction shown by an arrow, with reference to FIGS. 4 and 5, as it exits the main track 210 (and is no longer supported upon it). Some overlap is provided such that for a length of the ride path (e.g., 5 to 20 feet or the like), both the main track 210 and the inlet portion of the transfer guide track 240 are guiding the direction of the vehicle 370B and in the same direction/radius to avoid binding the vehicle 370B. The vehicle 370A then transitions off the main track 210 and onto the station track 220 that will support the load of the vehicle using the up-stop wheels 386 with channel surface 222. The vehicle 370A is now guided by the inlet portion of the transfer guide track 240, and the vehicle 370A is supported by the station track 220 and the up-stop wheels 386, as is shown in FIGS. 4 and 5.

Figure 6:
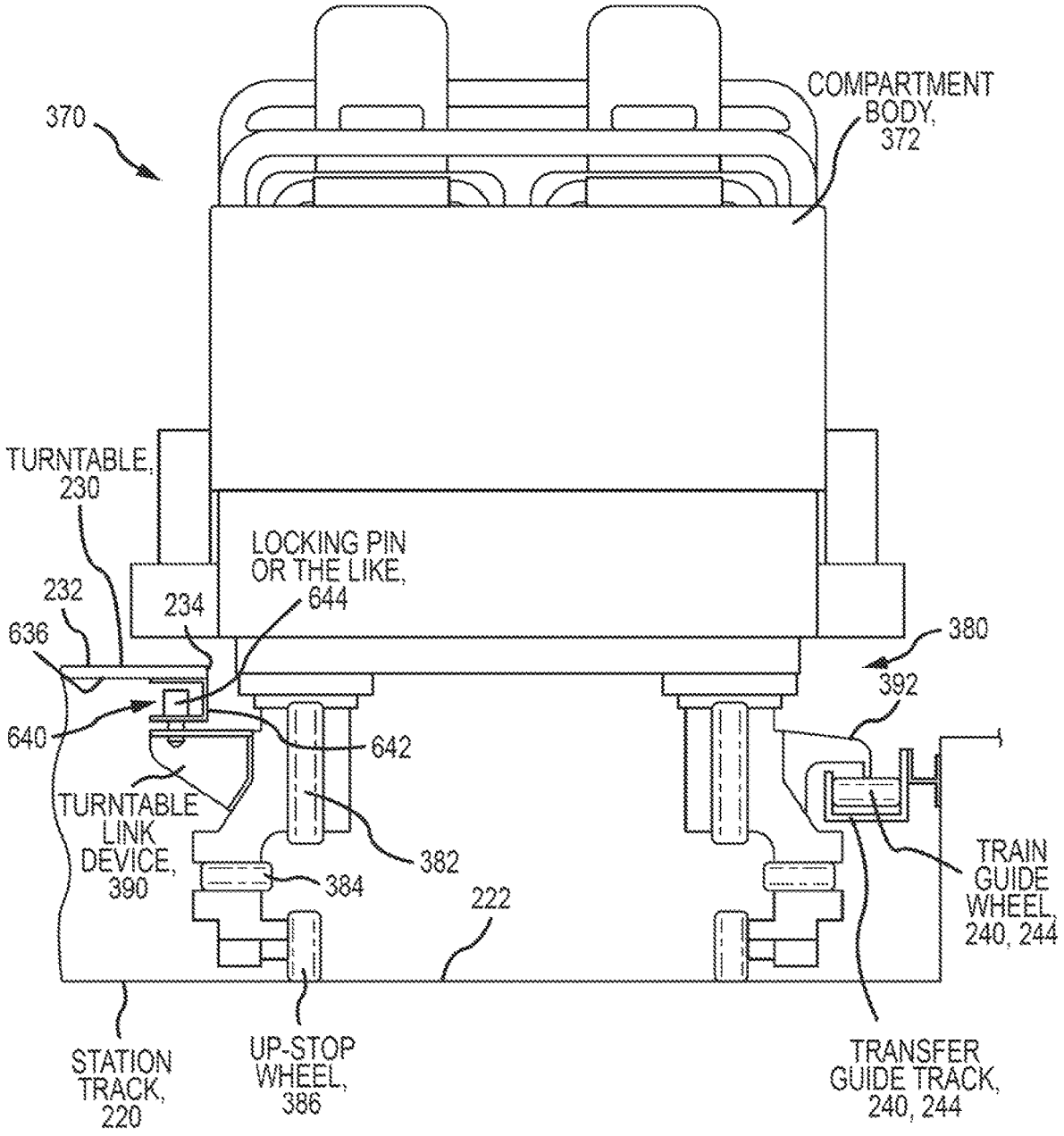
FIG. 6 illustrates another end view of the vehicle similar to FIGS. 3 and 4 showing the vehicle after engagement with the turntable and while still being guided by a section of the transfer guide track.

The inlet portion of the transfer guide track 240 guides the vehicles 370A and 370B toward the rotating turntable 230 until they are position tangent to the turntable. As shown in FIG. 6, the vehicle 370 then is linked to the turntable 230 by engagement of the turntable coupling mechanism 640 (which, in this configuration, is mounted to a lower or bottom surface 636 of the turntable 230 near its outer or peripheral edge 234) with the turntable link device(s) 390 of the vehicle 370. In the illustrated example, a spring-loaded (or actuated) locking pin 644 extends into a hole of the link device 390 in a passive (or actuate) manner as the vehicle 370 is guided into the tangent position. For some length of the station track 220 (e.g., 5 to 20 feet), the guide track 240 continues to guide the vehicle 370 as shown until the vehicle 370 is moved by the turntable 230 along the station track 220 away from the station entrance 212. In some configuration, the transfer guide track 240 can be continuous from the station entry 212 to the station exit 214, and the vehicle 370 will be guided throughout the station area.

The vehicle 370 is mechanically coupled or linked to the edge 234 of the turntable 230 such that the vehicle 370 travels at the exact same angular velocity as the rotating turntable 230, which ensures easy ingress/egress for the passengers from the vehicle 370 (e.g., onto the upper surface 232 of the turntable 230). The mechanical linkage also acts as a guide for the vehicle 370 to move it around the circular station track 220, in which case, the transfer guide track 240 is no longer needed and the vehicle 370 transitions out of the inlet portion of the transfer guide track 240. The turntable 230 is now the method of moving and guiding the vehicle 370 around the circular path defined by the station track 220 towards the station exit 214.

Figure 7:
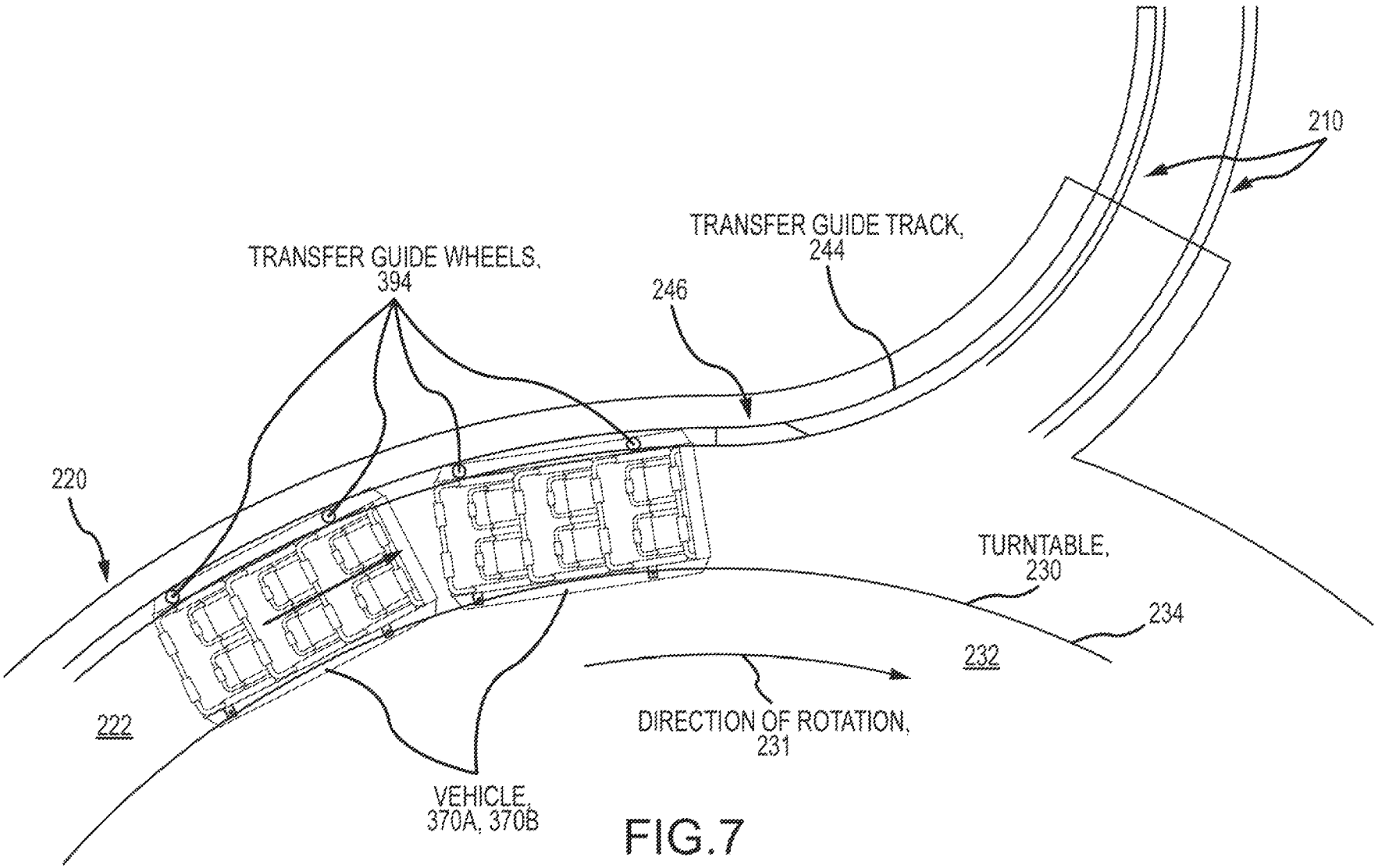
FIG. 7 illustrates the pair of vehicles of FIG. 5 traveling in the station on the station track with the rotation of the turntable and when initially engaging the transfer guide track provided proximate to the outlet of the station.

Next, as shown in FIG. 7, the vehicles 370A and 370B have traveled around station 200 on the station track 220 in areas of the turntable upper surface 232 in which passengers are intended to unload and load. As the vehicles 370A and 370B approach the station exit 214, the vehicles 370A and 370B engages with the outlet portion of the transfer guide track 244 (with the transfer guide wheel 394 rolling within a groove of the track 244 in this non-limiting example as shown in FIG. 4).

Figure 8:
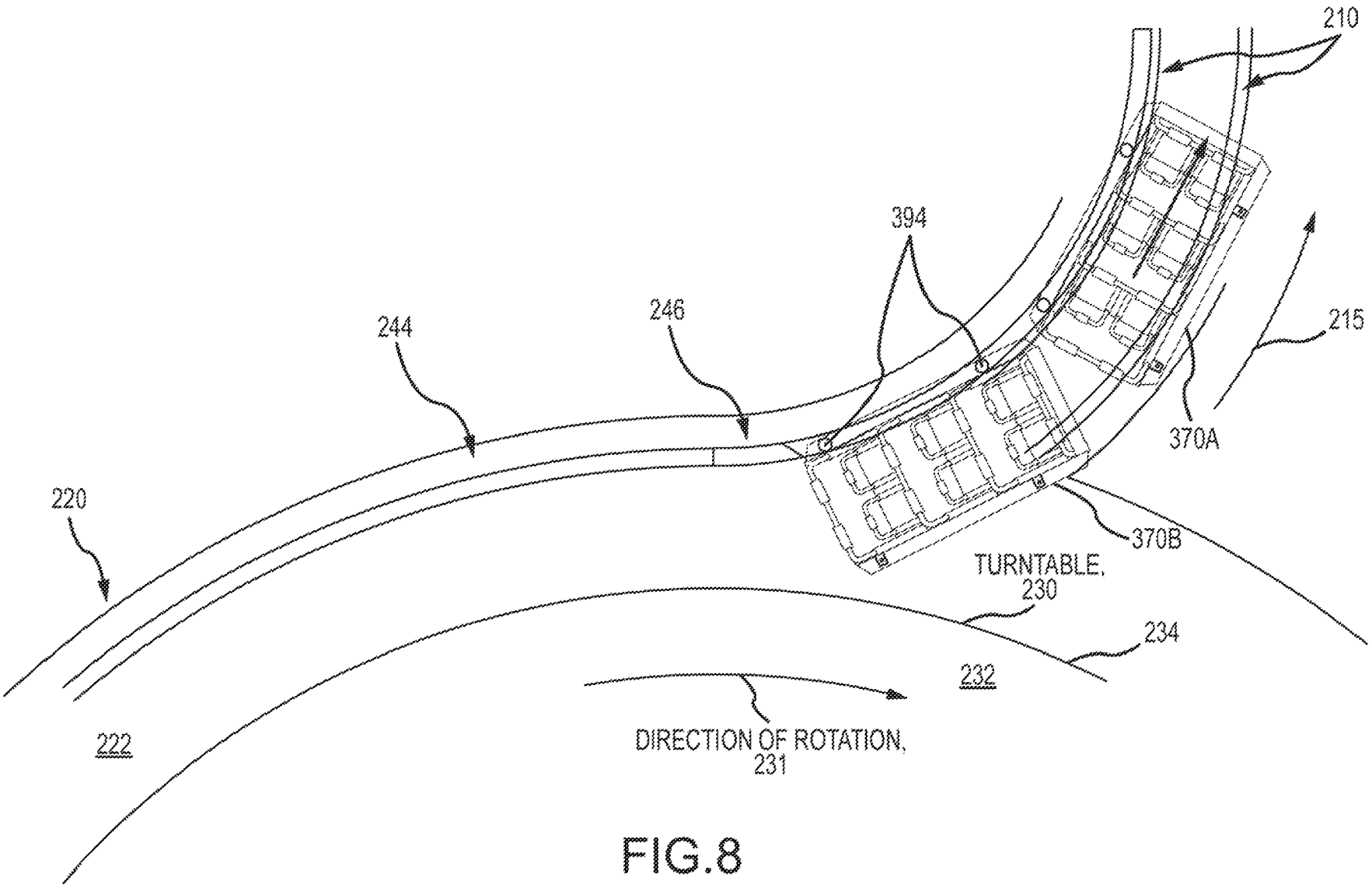
FIG. 8 illustrates the pair of vehicles of FIG. 7 at a later time (or after further rotation of the turntable) showing an example of a station operating condition when an operator has acted to release the pair of vehicles from the turntable.

At this point, the ride operator has a decision to make. If the vehicle 370A and/or 370B is ready to be released from the station 200 into the attraction, the operator commands the dispatch of the vehicle 370A and/or 370B to exit the station 200 and into the ride area on the main track 210 at the station outlet/exit 214. If "release" (or proper loading and unloading) is indicated by the operator such as via input on an operator's input device, the ride control system responds by activating the release mechanism/actuator to decouple the capture mechanism from the turntable link device(s) 390 on the vehicle 370A and/or 370B to release it from the turntable 230. The transfer guide track 244 then guides the vehicle 370A and/or 370B out of the station 200 and into the attraction as shown in FIG. 8 (with this figure showing both vehicles 370A and 370B being released but one or both could remain captured and forced to make another loop with the turntable 230).

Figure 9A:
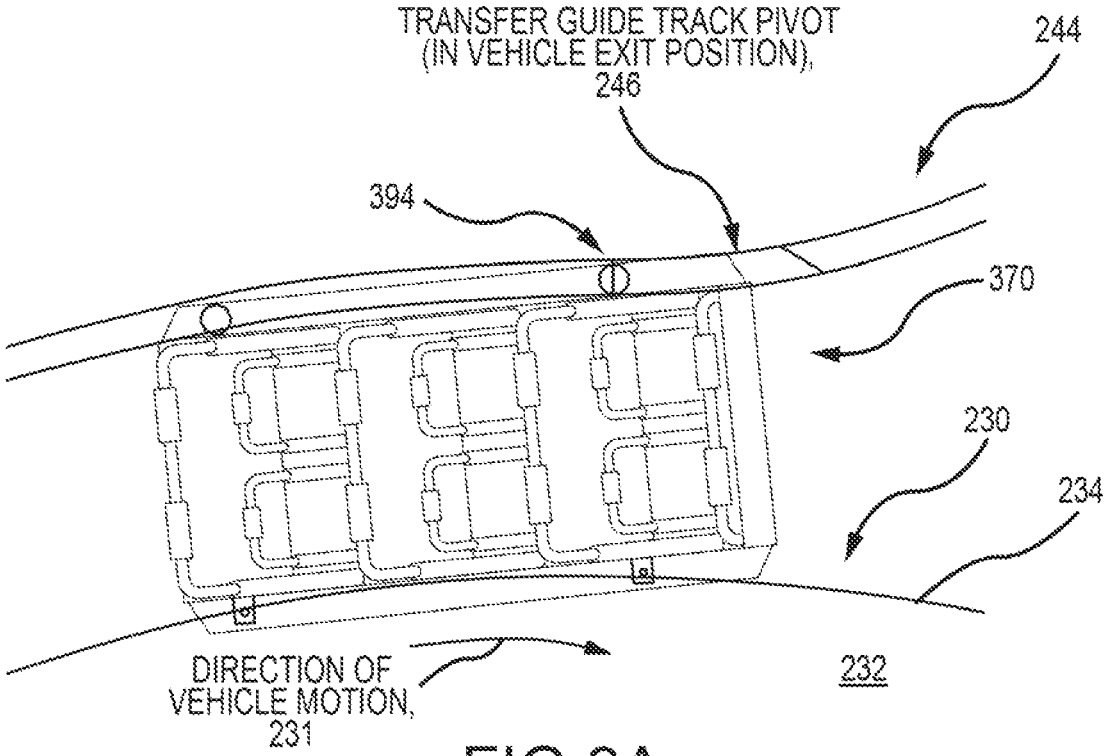
FIGS. 9A-9D illustrate an operating condition in which one of the vehicles is not released by an operator (e.g., to provide longer or extended egress or ingress by passengers to the vehicle) showing the vehicle continuing to travel with the turntable on the station track away from the station outlet.
Figure 9B:
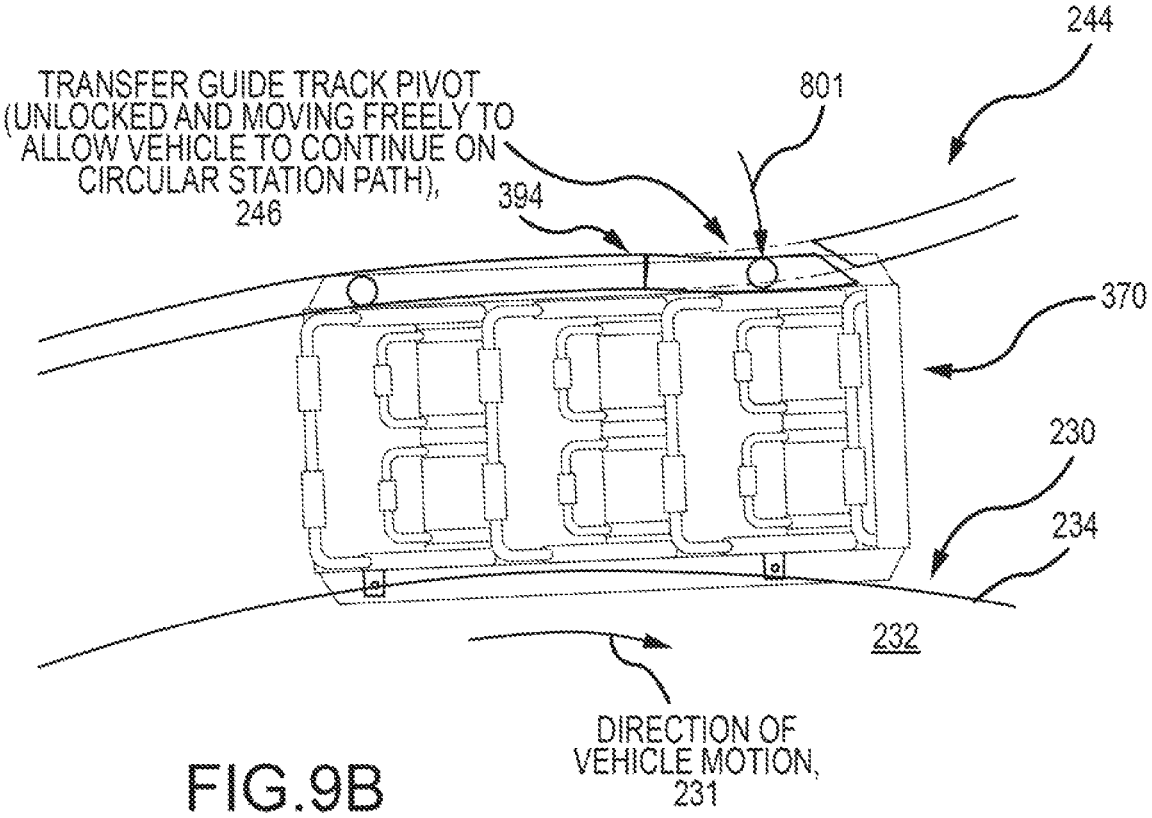

If the vehicle 370A and/or 370B is not determined by the operator to not be ready to be released when in the exit position shown in FIG. 9A, the operator does not have to perform any task or provide any input, and the vehicle remains mechanically linked to the turntable 330 and continues around the turntable 230 as shown in FIGS. 9A-9D to the side with the station entrance 212. Since the vehicle 370 is already engaged with the outlet portion of the transfer guide track 344, the station 200 has to be configured to disengage the vehicle 370 from the guide track 344, otherwise the vehicle 370 will be guided in two different directions and bind. One useful embodiment of the station 200 is configured with a section 346 of the outlet portion of the transfer guide track 344 that is adapted to pivot, as shown with arrow 801, to allow the vehicle transfer guide wheel 394 to pull the pivotable section 346 open or towards the turntable 230 as shown in FIG. 9B.

Figure 9C:
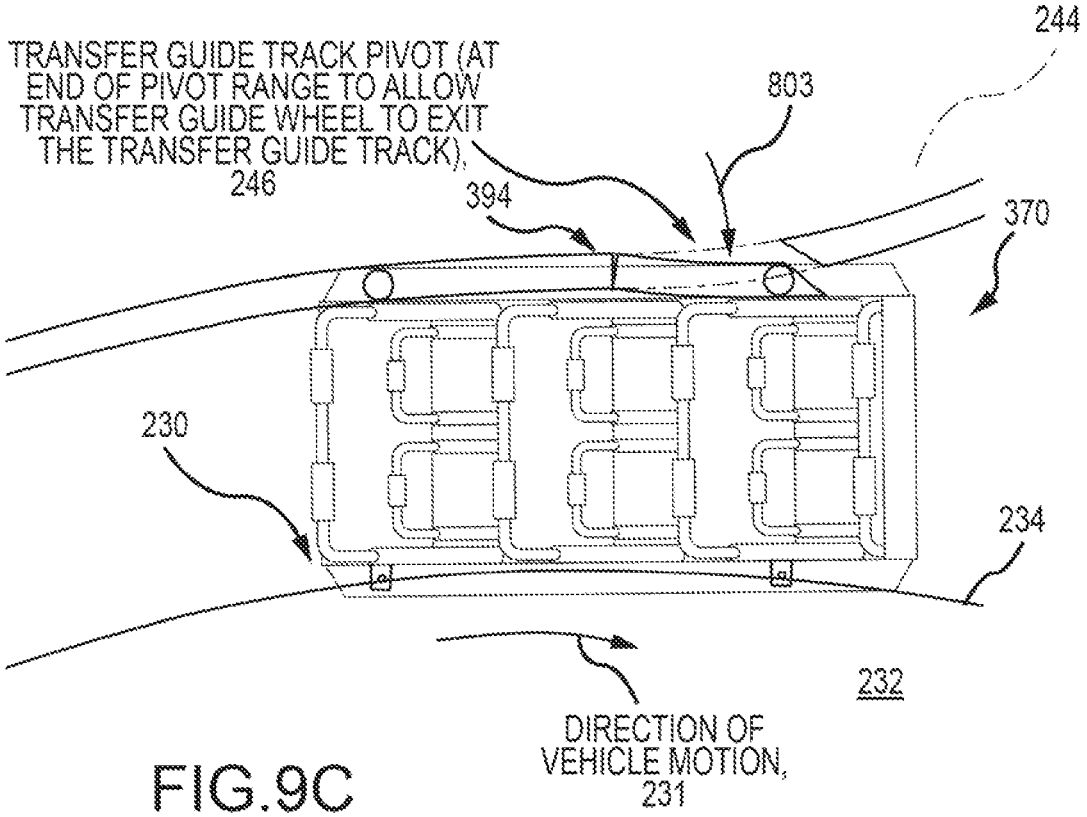
Figure 9D:
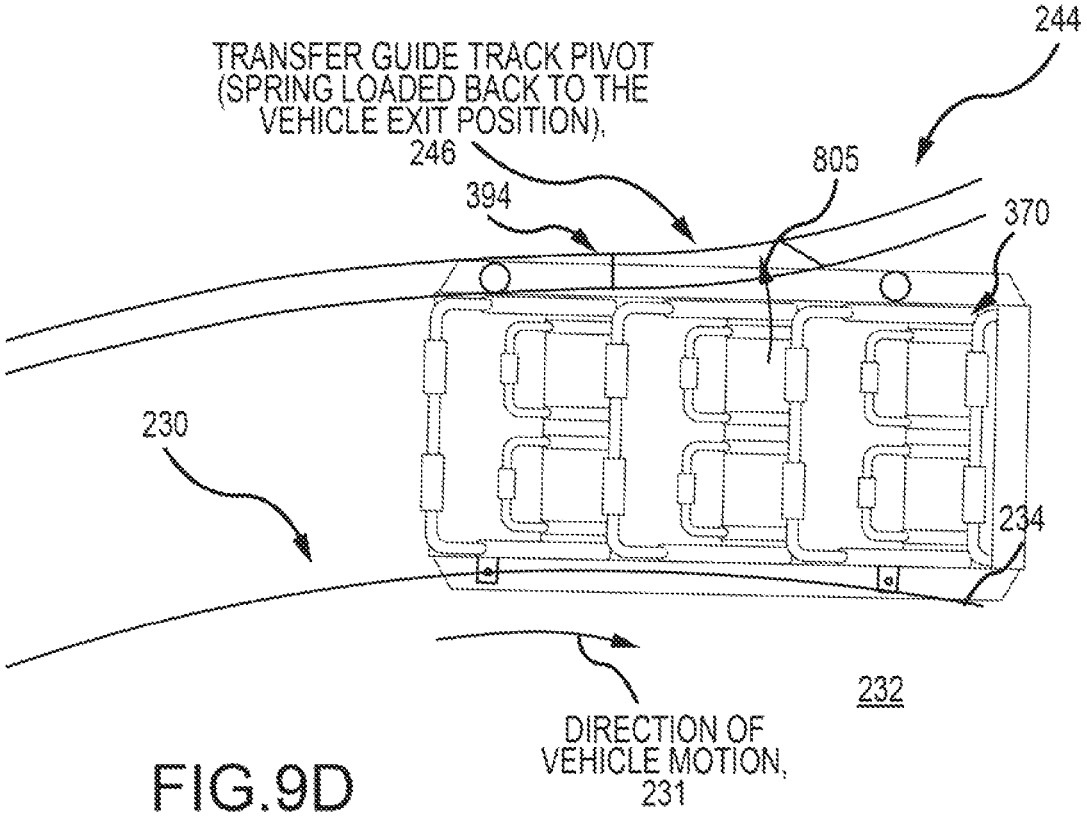

Because the vehicle 370 is still being guided and/or driven by the turntable 230, this action could be passive and only use the forward motion of the vehicle 370 to pivot the guide track section 246. Once the vehicle 370 travels far enough to allow the transfer guide wheel 394 to pull out of the transfer guide track 344, the pivotable section 346 returns to its original position (e.g., such as with a spring retention member(s) or the like (not shown but understood) used to hold it in place and return it to the closed or vehicle exit position away from the turntable 230), as can be seen in FIGS. 9C and 9D.

Figures 10A, 10B:
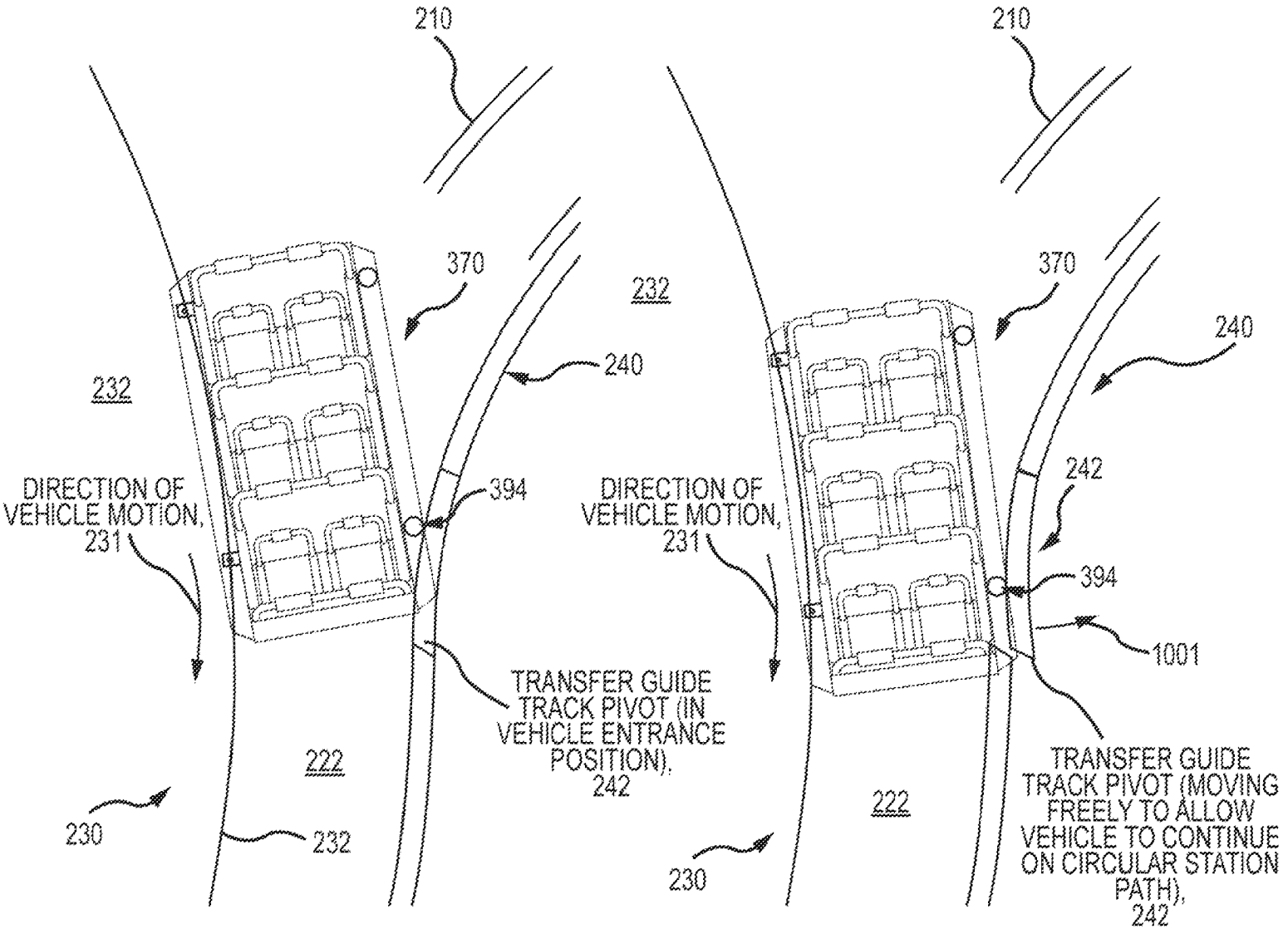
FIGS. 10A-10D illustrate the vehicle of FIGS. 9A-9D as the vehicle travels into the transfer guide track proximate to the inlet to the station for another rotation of the turntable.
Figure 10D:
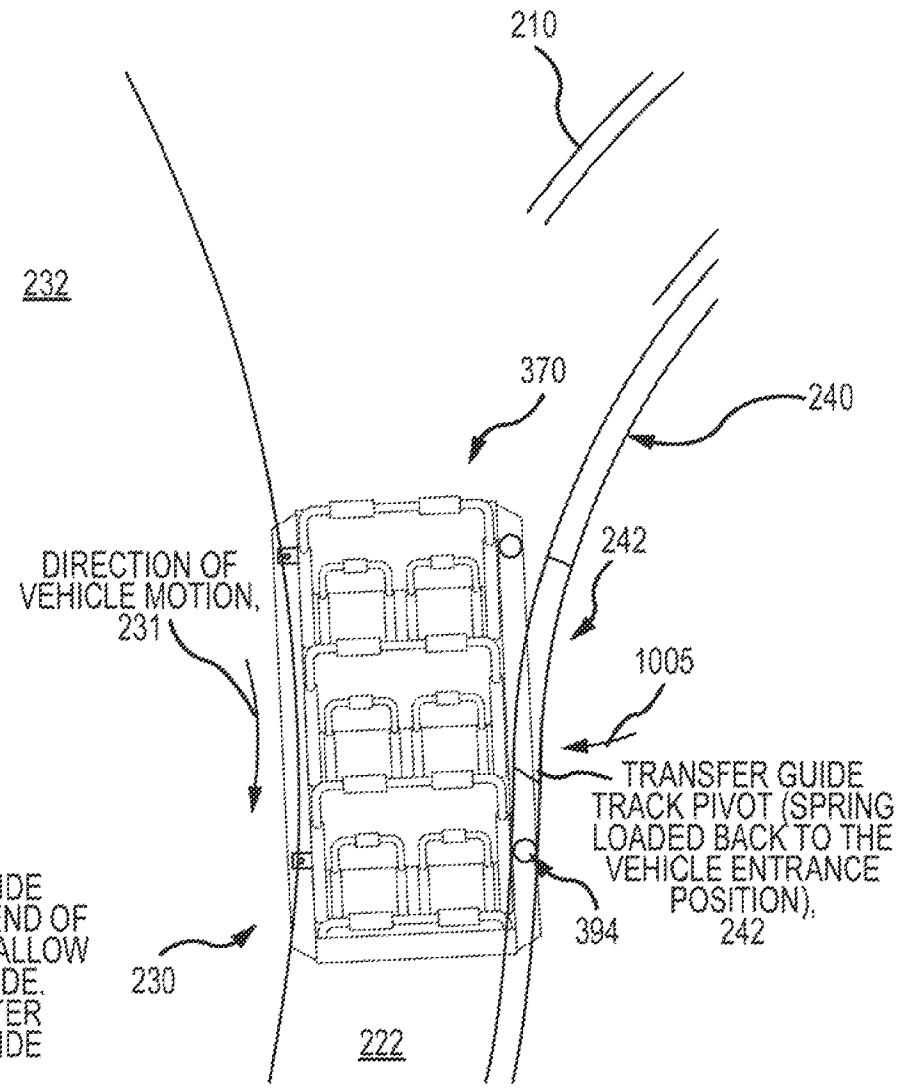
Figure 10C:
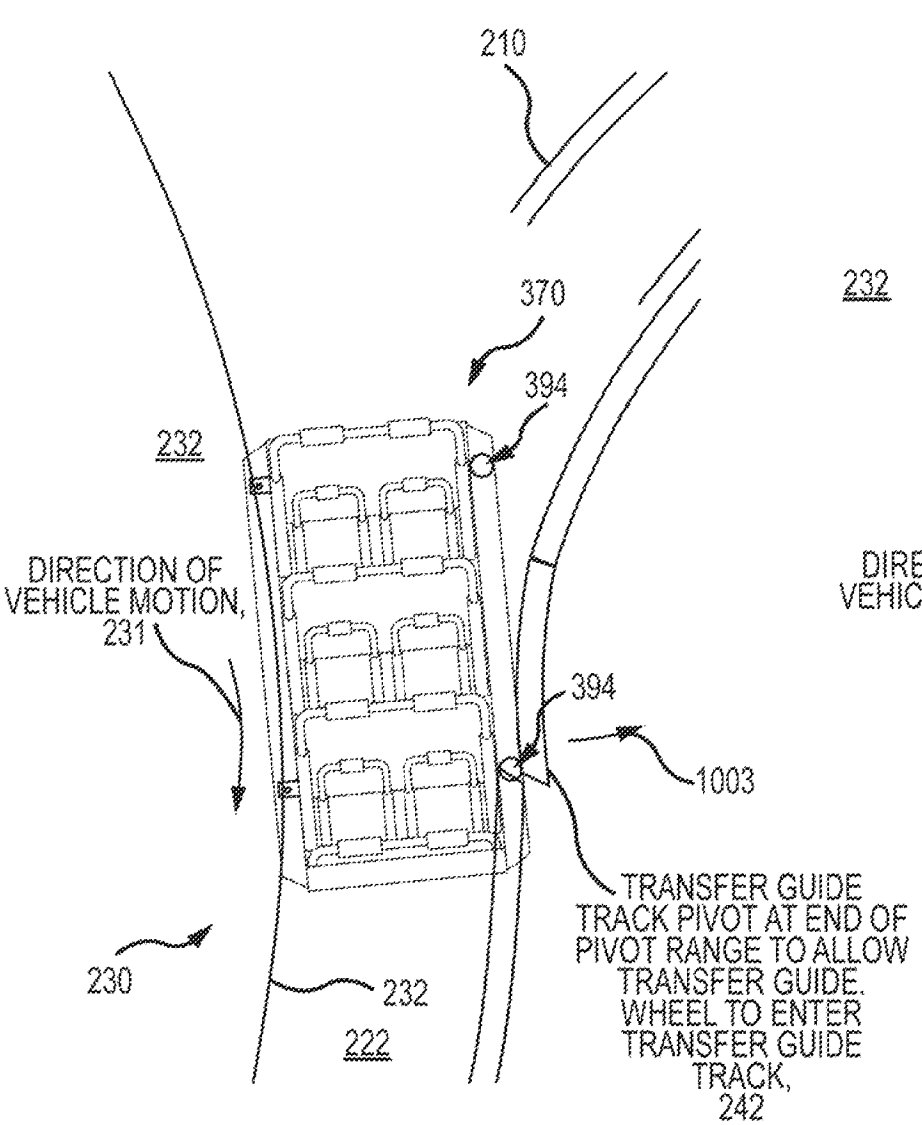

Then, as the vehicle continues around the turntable 230 on the station track 220, it will return to where it first entered the turntable station 200 at the station entrance 212. At this point, as shown in FIGS. 10A-10D, the inlet portion of the transfer guide track 240 would interfere with the transfer guide wheel 394. However, the inlet portion of the transfer guide track 240 includes a pivotable section 242 similar to section 246 that is adapted to allow the returning vehicle 370 to re-engage the inlet portion of the transfer guide track 240. Particularly, FIG. 10A shows the vehicle 370 being moved by the turntable 230 on the station track 220 until the front transfer guide wheel 394 first contacts the outer wall of the pivotable section 242. FIG. 10B shows the direction of the vehicle motion 231 applying a force on the pivotable section 242 causing it to pivot or move, as shown with arrow 1001, freely to allow the vehicle 370 to continue on the circular station track 220. FIG. 10C shows the pivotable section 242 at the end of its pivot range guiding so the transfer guide wheel 394 of the vehicle 370 can reenter the transfer guide track 240. FIG. 10D shows the spring loaded pivotable section 242 springing or snapping back, as shown with arrow 1005, into the closed or vehicle entrance position/state.

The vehicle 370 can re-start the unload/load process, and the ride operator can release the vehicle 370 into the attraction on the next loop, if the vehicle 370 is ready. This vehicle 370 can continue to move around the turntable for an infinite amount of time, allowing the passenger(s) as much time as they need to load or unload the vehicle 370 without interruption or feeling as if they are delaying other vehicles in the series.

Figure 11:
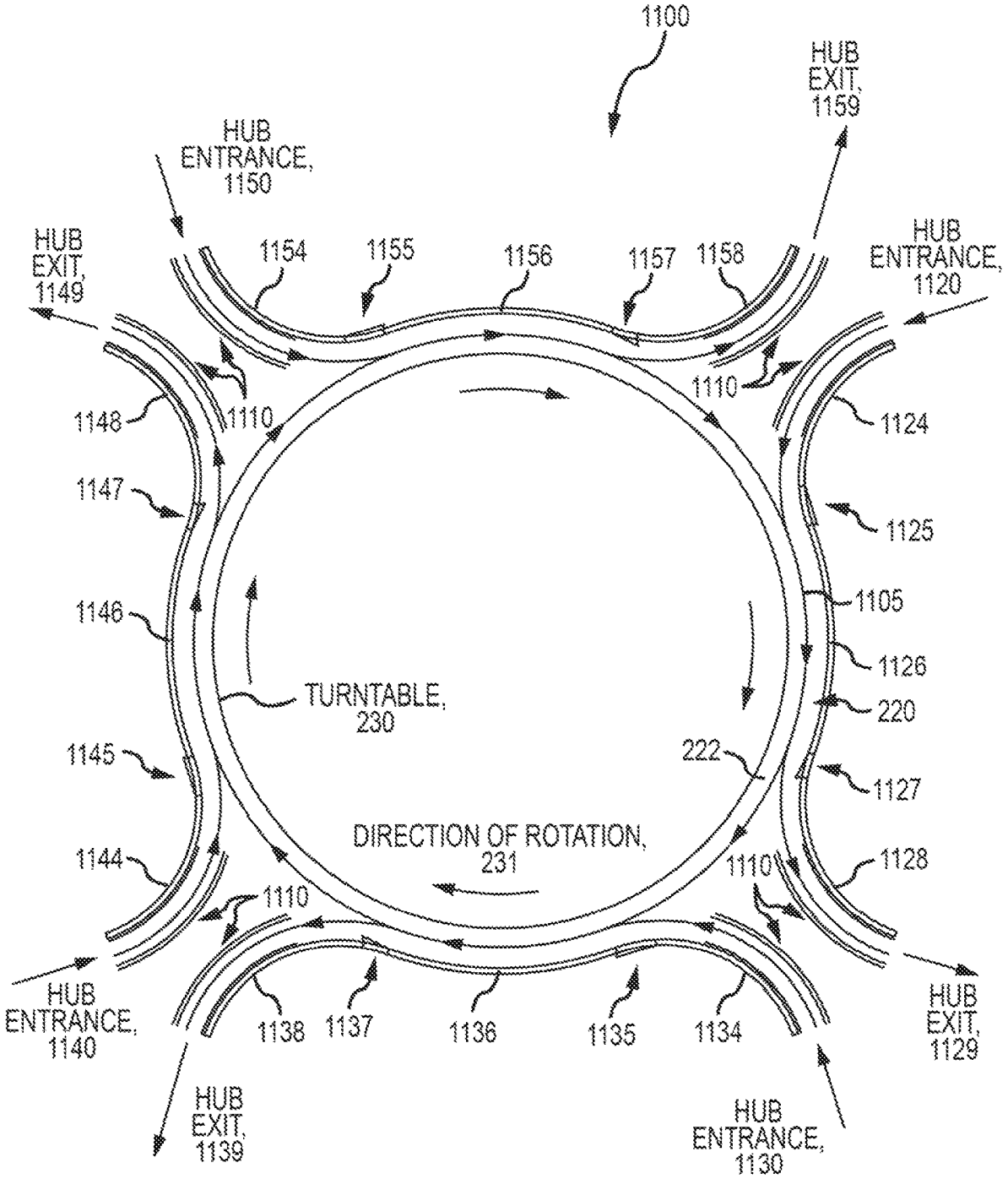
FIG. 11 illustrates another embodiment of a station for use in the ride of FIG. 1 that is similar to that shown in FIG. 2 but configured to provide two or more station (or "hub") entrances/inlets and two or more station (or hub) exits/outlets.

In some cases, it may be useful to provide the transfer mechanisms and concepts used in the ingress/egress stations described above in different portions of the system or ride track to selectively redirect vehicles. FIG. 11 illustrates another embodiment of a station 1100 for use in the ride 100 of FIG. 1 that is similar to that shown in FIG. 2 but that is configured to provide two or more station (or "hub") entrances/inlets and two or more station (or hub) exits/outlets. The station 1100 may be considered a multiple track turntable or hub, which utilizes similar concepts as above while also including multiple exit and entry points on the turntable 230 instead of just one pair.

The station 1100 allows for multiple options for a ride experience. This hub/station 1100 can be placed out in a ride area (e.g., away from the load/unload area) and provide passengers riding the vehicles with an option to decide which of two or more ride paths they want to take in real time, with arrowed line 1105 showing various paths that a vehicle may travel at the station 1100). They would not have to experience any of these differing branches or sub-path in the overall ride path in any specified order because they can simply cause their vehicle to loop around the station's turntable 230 (e.g., by providing user input to the ride control system indicating a time for release from being linked to the turntable 230 via a device on or in the vehicle) to try a different branch if the vehicle previously passed it. One can readily imagine passengers being able to decide which planet or galaxy of an attraction they want to visit in a universe-type attraction or deciding which movie/television story they want to experience. Also, track downtimes for repairs and the like can be better accommodated by simply blocking off one of the branches or station exits from current use without affecting the operation of the greater ride.

As shown, the station or hub 1100 includes a turntable 230 similar to the ones described above that is rotated in an ongoing or continuous manner as shown with arrow 231. A station track 220 is provided adjacent the outer edge of the turntable 230 and extends about the entire circumference of the turntable 230. The station 1100 further includes portions of the main track 1110 at the four hub entrances 1120, 1130, 1140, 1150 and four hub exits 1159, 1129, 1139, 1149 that are paired with these station exits. At the entrances 1120, 1130, 1140, and 1150, an inlet portion of the transfer guide track 1124, 1134, 1144, and 1154 is provided (each with a pivotable section 1125, 1135, 1145, 1155) to transfer a vehicle (not shown but understood from FIGS. 1-10D) onto the station track 220 and capture by the turntable 230 (as explained above with reference to FIGS. 1-10D). At the exits 1129, 1139, 1149, and 1159, an outlet portion of the transfer guide track 1128, 1138, 1148, and 1158 is provided (each with a pivotable section 1127, 1137, 1147, and 1157) to transfer a vehicle off of the station track 220 after release from the turntable 230. Optionally, intermediate sections of the transfer guide track 1126, 1136, 1146, and 1156 may be provided between the entrance/exit pairs to provide vehicle guidance in the main track 220.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The station described herein for providing indefinite load and unload times in vehicle in series arrangements may be utilized in a wide variety of ride designs. For example, the station may be included in a roller coaster, a flume ride, a raft ride, or a dark ride. The track and vehicle link systems may vary from the examples shown here to some degree, but the overall concept for selectively taking one, two, or more vehicles out of a series without interrupting travel or movement along a ride path by other vehicles remains the same.

I claim:

1. A ride system, comprising:

a plurality of vehicles;

a main track for guiding the vehicles in a series along a ride path;

a turntable rotating in a continuous manner about a center axis while the ride system is operating;

a station track extending about an outer edge of the turntable to define a circular loop around a periphery of the turntable, wherein the main track includes a turntable inlet that directs the vehicles in the series toward the station track and a turntable outlet providing an exit for the vehicles away from the station track; and a transfer guide track with an inlet portion configured to guide the vehicles from the turntable inlet of the main track to the station track and with an outlet portion configured to guide the vehicles from the station track to the turntable outlet of the main track, wherein one or more of the vehicles is guided to bypass the turntable outlet and continue to travel within the station track past the turntable inlet of the main track and back to the turntable outlet of the main track, and wherein the inlet portion and the outlet portion each comprises a pivotable track section that is acted upon by the one or more vehicles that are guided to bypass the turntable outlet to rotate out of a path of the one or more vehicles and to then spring back into place, thereby allowing the one or more vehicles to continue to travel in the station track without binding with the transfer guide track.

2. The ride system of claim 1, further comprising a vehicle capture system including a vehicle-to-turntable coupling mechanism independently coupling each of the vehicles arriving from the turntable inlet of the main track to the turntable, whereby the vehicles are driven in the station track by rotation of the turntable.

3. The ride system of claim 2, wherein the vehicle capture system includes a release mechanism activated in response to a control signal from a ride control system to independently decouple each of the vehicles when traveling in the outlet portion of the transfer guide track except for the one or more of the vehicles that are guided to bypass the turntable outlet.

4. The ride system of claim 3, wherein the vehicle-to-turntable coupling mechanism includes a plurality of spring-loaded pins or balls mounted on the turntable and a turntable link device on a chassis of each of the vehicles with a hole or recessed surface for receiving one of the spring-loaded pins or balls.

5. The ride system of claim 1, wherein each of the vehicles comprises a transfer guide wheel extending outward from a side of the chassis opposite the turntable as the vehicle travels within the station track and wherein the transfer guide track includes two or more surfaces for mating with the transfer guide wheels of the vehicles.

6. The ride system of claim 1, wherein the station track comprises a channel with a bottom surface supporting and mating with up-stop wheels of the vehicles to provide vertical support of the vehicles while traveling around the turntable.

7. The ride system of claim 6, wherein the transfer guide track is mounted on a sidewall of the channel of the station track that is opposite the turntable.

8. The ride system of claim 1, wherein the main track has an additional one or more of the turntable inlets and an additional one or more of the turntable outlets to provide access to an additional one or more branches of the ride path, wherein the transfer guide track includes additional inlet and outlet portions paired with the additional turntable inlets and outlets, and wherein each of the vehicles can selectively exit the station track via the transfer guide track through any one of the turntable outlets.

9. A transportation system, comprising:

a plurality of uncoupled roller coaster vehicles;

a main track for guiding the vehicles along a ride path;

a turntable rotating about a center axis;

a station track extending about an outer edge of the turntable to define a circular loop around a periphery of the turntable, wherein the main track includes a turntable inlet that directs the vehicles toward the station track and a turntable outlet providing an exit for the vehicles away from the station track;

a transfer guide track with an inlet portion configured to guide the vehicles from the turntable inlet of the main track to the station track and with an outlet portion configured to guide the vehicles from the station track to the turntable outlet of the main track; and a vehicle capture system coupling each of the vehicles arriving from the turntable inlet of the main track to the turntable, whereby the vehicles are driven in the station track by rotation of the turntable, wherein the vehicle capture system includes a release mechanism adapted to decouple a first set of the vehicles when in the outlet portion of the transfer guide track and to retain in a captured state a second set of the vehicles that are guided to bypass the turntable outlet, and wherein the inlet portion and the outlet portion each comprises a pivotable track section that is acted upon by the vehicles in the second set to rotate out of a path of the vehicles, thereby allowing each of the second set of vehicles to continue to travel in the station track without binding with the transfer guide track.

10. The transportation system of claim 9, wherein the vehicle capture system includes a plurality of spring-loaded pins or balls mounted on the turntable and a turntable link device on a chassis of each of the vehicles with a hole or recessed surface for receiving one of the spring-loaded pins or balls.

11. The transportation system of claim 9, wherein each of the vehicles comprises a transfer guide wheel extending outward from a side of the chassis opposite the turntable as the vehicle travels within the station track and wherein the transfer guide track includes two or more surfaces for mating with the transfer guide wheels of the vehicles.

12. The transportation system of claim 9, wherein the station track comprises a channel with a bottom surface supporting and mating with up-stop wheels of the vehicles to provide vertical support of the vehicles while traveling around the turntable.

13. The transportation system of claim 12, wherein the transfer guide track is mounted on a sidewall of the channel of the station track that is opposite the turntable.

14. The transportation system of claim 9, wherein the main track has an additional one or more of the turntable inlets and an additional one or more of the turntable outlets to provide access to an additional one or more branches of the ride path, wherein the transfer guide track includes additional inlet and outlet portions paired with the additional turntable inlets and outlets, and wherein each of the vehicles can selectively exit the station track via the transfer guide track through any one of the turntable outlets.

15. A ride system, comprising:

a main track defining a ride path;

a plurality of vehicles each adapted to rollably engage the main track;

a turntable rotating in a continuous manner about a center axis while the ride system is operating;

a station track extending about an outer edge of the turntable to define a circular loop around a periphery of the turntable and to provide one or more surfaces for vertically supporting the vehicles, wherein the main track includes a turntable inlet that directs the vehicles in the series toward the station track and a turntable outlet providing an exit for the vehicles away from the station track;

a vehicle capture system including a vehicle-to-turntable coupling mechanism independently coupling each of the vehicles arriving from the turntable inlet of the main track to the turntable, whereby the vehicles are driven in the station track by rotation of the turntable; and a transfer guide track with an inlet portion configured to guide the vehicles from the turntable inlet of the main track to the station track and with an outlet portion configured to guide the vehicles from the station track to the turntable outlet of the main track, wherein one or more of the vehicles is guided to bypass the turntable outlet and continue to travel within the station track past the turntable inlet of the main track and back to the turntable outlet of the main track, and wherein the inlet portion and the outlet portion each comprises a pivotable track section that is acted upon by the one or more vehicles that are guided to bypass the turntable outlet to rotate out of a path of the one or more vehicles and to then spring back into place, thereby allowing the one or more vehicles to continue to travel in the station track without binding with the transfer guide track.

16. The ride system of claim 15, wherein the vehicle capture system includes a release mechanism activated in response to a control signal from a ride control system to independently decouple each of the vehicles when traveling in the outlet portion of the transfer guide track except for the one or more of the vehicles that are guided to bypass the turntable outlet.

17. The ride system of claim 16, wherein the vehicle-to-turntable coupling mechanism includes a plurality of spring-loaded pins or balls mounted on the turntable and a turntable link device on a chassis of each of the vehicles with a hole or recessed surface for receiving one of the spring-loaded pins or balls.

18. The ride system of claim 15, wherein each of the vehicles comprises a transfer guide wheel extending outward from a side of the chassis opposite the turntable as the vehicle travels within the station track and wherein the transfer guide track includes two or more surfaces for mating with the transfer guide wheels of the vehicles.

19. The ride system of claim 15, wherein the main track has an additional one or more of the turntable inlets and an additional one or more of the turntable outlets to provide access to an additional one or more branches of the ride path, wherein the transfer guide track includes additional inlet and outlet portions paired with the additional turntable inlets and outlets, and wherein each of the vehicles can selectively exit the station track via the transfer guide track through any one of the turntable outlets.

20. The ride system of claim 1, wherein a motion of the one or more vehicles that are guided to bypass the turntable outlet applies a force on the track section to cause the track section to move to allow the one or more vehicles to continue on the station track.

* * * * *